US009127619B2

(12) United States Patent
Lineton et al.

(10) Patent No.: US 9,127,619 B2
(45) Date of Patent: Sep. 8, 2015

(54) PISTON WITH A COOLING GALLERY PARTIALLY FILLED WITH A THERMALLY CONDUCTIVE METAL-CONTAINING COMPOSITION

(71) Applicant: Federal-Mogul Corporation, Southfield, MI (US)

(72) Inventors: Warran Boyd Lineton, Ann Arbor, MI (US); Miguel Azevedo, Ann Arbor, MI (US)

(73) Assignee: Federal-Mogul Corporation, Southfield, MI (US)

( * ) Notice: Subject to any disclaimer, the term of this patent is extended or adjusted under 35 U.S.C. 154(b) by 9 days.

(21) Appl. No.: 14/070,839

(22) Filed: Nov. 4, 2013

(65) Prior Publication Data

US 2014/0123930 A1 May 8, 2014

Related U.S. Application Data

(60) Provisional application No. 61/721,682, filed on Nov. 2, 2012.

(51) Int. Cl.

| | |
|---|---|
| ***F02F 3/02*** | (2006.01) |
| ***F02F 3/16*** | (2006.01) |
| ***F02F 3/18*** | (2006.01) |

(52) U.S. Cl.

CPC ... *F02F 3/16* (2013.01); *F02F 3/18* (2013.01); *Y10T 29/49249* (2015.01)

(58) Field of Classification Search

CPC ..... F02F 3/16; F02F 3/18; F02F 3/22; Y10T 29/49249

USPC ..... 123/41.35, 193.6, 41.16, 41.42

See application file for complete search history.

(56) References Cited

U.S. PATENT DOCUMENTS

| | | | |
|---|---|---|---|
| 711,606 | A | 10/1902 | White |
| 1,373,291 | A | 3/1921 | Betker |

(Continued)

FOREIGN PATENT DOCUMENTS

| | | | |
|---|---|---|---|
| GB | 263055 | A | 12/1926 |
| JP | 62096762 | A | 4/1987 |
| WO | 2013119892 | A1 | 8/2013 |

OTHER PUBLICATIONS

International Search Report mailed Mar. 25, 2014 (PCT/US2013/068206).

*Primary Examiner* — Marguerite McMahon

(74) *Attorney, Agent, or Firm* — Robert L. Stearns; Dickinson Wright, PLLC

(57) ABSTRACT

A piston for an internal combustion engine comprises a sealed cooling gallery extending circumferentially around a center axis beneath a bowl rim of an upper crown. A metal-containing composition having a high thermal conductivity fills a portion of the sealed cooling gallery to dissipate heat. The metal-containing composition includes a base material having a melting temperature less than 181° C. and a plurality of metal particles having a thermal conductivity greater than the thermal conductivity of the base material. For example, the metal-containing composition can comprise copper particles dispersed in silicone oil, or copper particles dispersed in a mixture of alkali metals. During high temperature operation, as the piston reciprocates in the cylinder bore, the base material is liquid and flows throughout the cooling gallery to dissipate heat away from the upper and lower crowns.

20 Claims, 1 Drawing Sheet

(56) References Cited

U.S. PATENT DOCUMENTS

| | | | | |
|---|---|---|---|---|
| 1,678,957 | A | 7/1928 | Philipp | |
| 1,878,566 | A | 9/1932 | Woolson | |
| 1,905,582 | A | 4/1933 | Gazda | |
| 1,953,109 | A * | 4/1934 | Heron | 123/41.16 |
| 2,028,434 | A | 1/1936 | Bernard | |
| 2,126,306 | A | 8/1938 | Bernard | |
| 2,126,627 | A | 8/1938 | Fiedler | |
| 2,153,501 | A | 4/1939 | Harper, Jr. | |
| 2,155,383 | A | 4/1939 | Carr | |
| 2,168,103 | A | 8/1939 | Nicolle | |
| 2,537,174 | A | 1/1951 | Townhill | |
| 2,711,159 | A | 6/1955 | Nallinger | |
| 3,066,002 | A | 11/1962 | Rudkin, Jr. | |
| 3,485,143 | A | 12/1969 | Canady | |
| 3,545,341 | A | 12/1970 | Fischer | |
| 3,616,729 | A * | 11/1971 | Fischer | 92/56 |
| 4,546,048 | A | 10/1985 | Guenther | |
| 7,162,990 | B1 * | 1/2007 | Ioja et al. | 123/193.6 |
| 7,549,368 | B2 | 6/2009 | Heidrich et al. | |
| 7,637,241 | B2 | 12/2009 | Styron | |
| 8,863,718 | B2 * | 10/2014 | Rebello et al. | 123/193.6 |
| 2005/0087153 | A1 | 4/2005 | Moon | |
| 2007/0079775 | A1 * | 4/2007 | Lin et al. | 123/41.35 |
| 2010/0275873 | A1 * | 11/2010 | Gniesmer et al. | 123/193.6 |
| 2013/0032103 | A1 * | 2/2013 | Azevedo | 123/41.35 |
| 2013/0047948 | A1 * | 2/2013 | Heuschmann | 123/193.6 |
| 2013/0146017 | A1 * | 6/2013 | Muscas et al. | 123/193.6 |
| 2013/0206084 | A1 * | 8/2013 | Azevedo et al. | 123/41.35 |
| 2013/0312695 | A1 * | 11/2013 | Bischofberger | 123/193.6 |
| 2014/0083390 | A1 * | 3/2014 | Azevedo et al. | 123/193.6 |

* cited by examiner

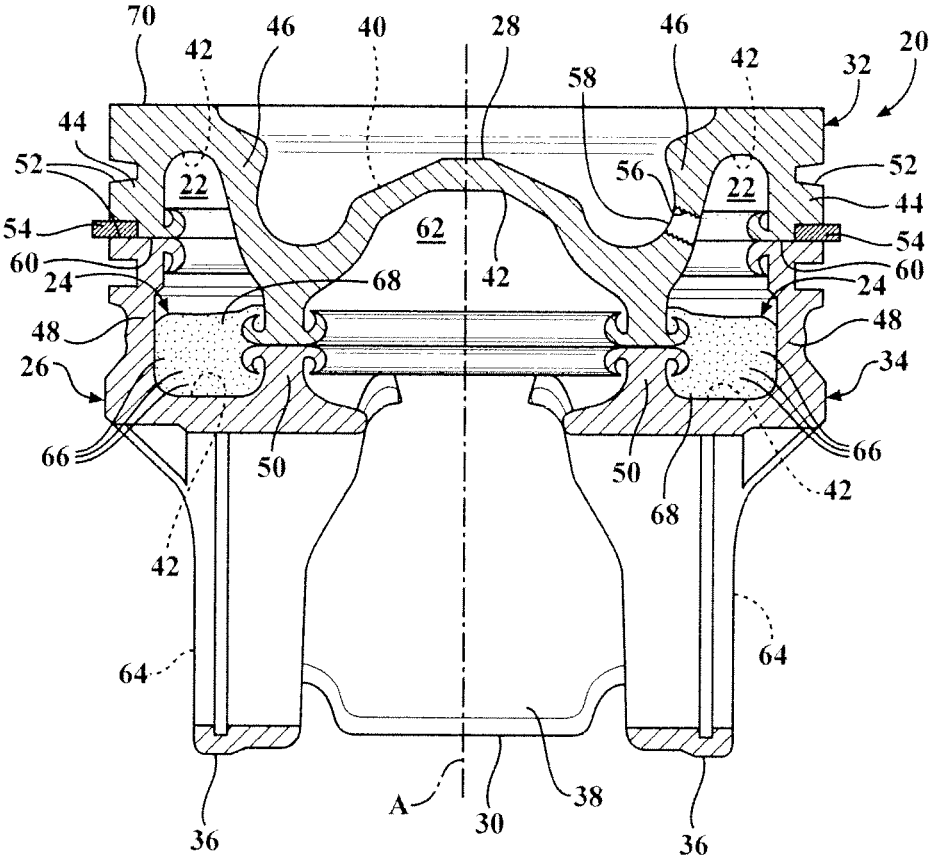
70
42
46
40
28
46
42
32
20
58
44
52
22
56
22
52
44
54
62
54
60
24
68
42
24
60
48
48
26
34
66
50
50
66
42
68
42
64
64
36
A
30
38
36

PISTON WITH A COOLING GALLERY PARTIALLY FILLED WITH A THERMALLY CONDUCTIVE METAL-CONTAINING COMPOSITION

CROSS REFERENCE TO RELATED APPLICATION

This application claims the benefit of U.S. Provisional Patent Application Ser. No. 61/721,682, filed Nov. 2, 2012, which is hereby incorporated by reference in its entirety.

BACKGROUND OF THE INVENTION

1. Field of the Invention

This invention relates generally to pistons for internal combustion engines, and methods for manufacturing the same.

2. Related Art

Pistons used in internal combustion engines, such as heavy duty diesel pistons, are exposed to extremely high temperatures during operation, especially along the upper crown of the piston. Therefore, to moderate temperatures, the pistons are typically designed with a cooling gallery beneath the upper crown, and cooling oil is sprayed into the cooling gallery as the piston reciprocates along a cylinder bore of the engine. The oil flows along the inner surface of the upper crown and dissipates heat away from the upper crown. However, to control the piston temperature during operation, a high flow of oil must be maintained constantly. In addition, the oil degrades over time due to the high temperatures of the internal combustion engine, and the oil must be changed periodically to maintain engine life.

SUMMARY OF THE INVENTION

One aspect of the invention provides a piston for an internal combustion engine. The piston comprises a body portion formed of a metal material. The body portion includes an upper crown and a sealed cooling gallery extending along least a portion of the upper crown. A metal-containing composition is disposed in the sealed cooling gallery. The metal-containing composition includes a base material having a melting temperature less than 181° C. and a plurality of metal particles having a thermal conductivity greater than the thermal conductivity of the base material.

Another aspect of the invention provides a method of manufacturing a piston for an internal combustion engine. The method comprises the steps of feeding the metal-containing composition into the cooling gallery; and sealing the cooling gallery.

During high temperature operation, the metal-containing composition flows throughout the sealed cooling gallery. Typically, the base material is in liquid form and carries the solid metal particles along the inner surface of the upper crown to remove heat therefrom. The metal-containing composition does not degrade due to high temperatures during the lifetime of the engine, and no coking of the cooling gallery occurs. The metal-containing composition functions as a coolant, and the higher heat transfer rate obtained from the metal-containing composition precludes oxidation and consequent erosion. In addition, the metal-containing composition can re-distribute heat flow and thus reduce carbon deposits along the outer surface of the upper crown, and can also reduce degradation of any lubricant oil used along the outer surface of the upper crown. The advantages provided by the metal-containing composition can also extend the time between service intervals of the engine.

In addition to the above, such a cooling method can be tuned to specific needs and could even deliberately induce a uniformly higher temperature along the top of the piston. This would favorably affect engine thermodynamics and provide additional heat in the exhaust for use by other appliances.

BRIEF DESCRIPTION OF THE DRAWING

Other advantages of the present invention will be readily appreciated, as the same becomes better understood by reference to the following detailed description when considered in connection with the accompanying drawing wherein:

FIG. 1 is a side cross-sectional view of a piston according to one exemplary embodiment of the invention.

DESCRIPTION OF THE ENABLING EMBODIMENT

Referring to the Figures, wherein like numerals indicate corresponding parts throughout the several views, an exemplary piston 20 for an internal combustion engine is generally shown in FIG. 1. The piston 20 includes a sealed cooling gallery 22 partially filled with a metal-containing composition 24 having a high thermal conductivity. The metal-containing composition 24 typically comprises a suspension of copper or aluminum particles dispersed in silicone oil or another equally high temperature stable liquid phase. In another embodiment, the metal-containing composition 24 includes a mixture of metals, such as copper particles dispersed throughout one or more alkali metals.

The exemplary piston 20 of FIG. 1 is a heavy duty diesel piston, which is disposed in a cylinder bore of the internal combustion engine. However, any other type of piston could be used with the metal-containing composition 24 in the cooling gallery 22. As shown in FIG. 1, the piston 20 includes a body portion 26 extending circumferentially around a center axis A and longitudinally along the center axis A from an upper end 28 to a lower end 30. The body portion 26 is formed of a metal material, such as steel, aluminum, or alloys thereof. In the exemplary embodiment, the body portion 26 includes an upper crown 32, a lower crown 34, a pair of pin bosses 36, and a skirt 38.

The upper crown 32 of the piston 20 includes an outer surface 40 and an oppositely facing inner surface 42. The outer surface 40 of the upper crown 32 presents a bowl-shaped configuration at the upper end 28 which is directly exposed to hot combustion gases in the cylinder bore during operation. The cooling gallery 22 extends along least a portion of the inner surface 42 of the upper crown 32, opposite the bowl-shaped configuration, so that the metal-containing composition 24 contained therein can dissipate heat away from the hot bowl-shaped configuration during operation. In the exemplary embodiment, the sealed cooling gallery 22 extends circumferentially around the center axis A, beneath a bowl rim 70 of the upper crown 32.

As shown in FIG. 1, the upper crown 32 includes a first outer rib 44 and a first inner rib 46 each extending circumferentially around the center axis A and longitudinally from the upper end 28 toward the lower end 30. The first ribs 44, 46 are spaced from one another, and the first inner rib 46 is disposed between the first outer rib 44 and the center axis A. The outer surface 40 of the first outer rib 44 presents a plurality of ring grooves 52 facing away from the center axis A and extending circumferentially around the center axis A for holding piston rings 54. The first inner rib 46 includes an opening 56 extending from the outer surface 40 of the upper crown 32 to the cooling gallery 22 for allowing the metal-containing composition 24 to be fed into the cooling gallery 22 prior to sealing the cooling gallery 22. However, in another preferred embodiment, the opening 56 is formed in the second inner rib 50 of the lower crown 34, along the non-thrust plane of the piston 20. A plug 58 is typically threaded into the opening 56 and then sealed with an adhesive, such as a high temperature epoxy composition. However, the opening 56 could alternatively be sealed using other methods, such as tungsten inert gas (TIG) welding, laser welding, or brazing the plug 58 to the opening 56. Another sealing technique includes press-fitting the plug 58 into the opening 56, which takes less production time compared to the threading or welding techniques.

The body portion 26 of the piston 20 also includes the lower crown 34 extending from the upper crown 32 toward the lower end 30. The lower crown 34 presents the outer surface 40 including at least one ring groove 52 for holding the piston rings 54. The lower crown 34 also includes the inner surface 42 facing opposite the outer surface 40. The lower crown 34 includes a second outer rib 48 aligned with and connected to the first outer rib 44 of the upper crown 32, and a second inner rib 50 aligned with and connected to the first inner rib 46 of the upper crown 32. The second ribs 48, 50 extend circumferentially around the center axis A between the upper end 28 and the lower end 30 and are spaced from one another by the inner surface 42 of the lower crown 34. Thus, as shown in FIG. 1, the inner ribs 46, 50 and outer ribs 44, 48 of the upper and lower crowns 32, 34 form the sealed cooling gallery 22 therebetween. The second ribs 48, 50 are typically connected to the first ribs 44, 46 by friction welds 60, but could be connected by another type of weld or connection.

As shown in FIG. 1, the inner surface 42 of the upper crown 32 and the first inner rib 46 present a cooling chamber 62 therebetween. The cooling chamber 62 extends radially along a portion of the inner surface 42 of the upper crown 32 and longitudinally along the center axis A and is open towards the lower end 30. During operation, the cooling chamber 62 is exposed to the cylinder bore, and oil may be sprayed into the cooling chamber 62 to reduce the temperature of the piston 20.

The body portion 26 of the piston 20 also includes the pair of pin bosses 36 depending from the lower crown 34 and presenting a pair of laterally spaced pin bores 64 extending perpendicular to the center axis A. The body portion 26 also includes the skirt 38 depending from the lower crown 34. The skirt 38 is joined laterally to the pin bosses 36 and spaces the pin bosses 36 from one another. The outer surface 40 of the skirt 38 is convex for cooperation with the cylinder bore. Although the piston 20 shown in FIG. 1 is a single piece construction, the piston 20 could alternatively comprise other designs.

As alluded to above, the metal-containing composition 24 has a high thermal conductivity for dissipating heat away from the hot upper crown 32 during operation in the internal combustion engine. The thermal conductivity of the metal-containing composition 24, measured in watts per meter-kelvin (W/m·K), ranges from 5 to 1000 times greater than the thermal conductivity of standard cooling oil. In one embodiment, the metal-containing composition 24 has a thermal conductivity of at least 100 W/m·K. The metal-containing composition 24 typically fills 20 vol. % to 50 vol. % of the cooling gallery 22, based on the total volume of the cooling gallery 22. In one exemplary embodiment, the metal-containing composition 24 fills 20 vol. % to 30 vol. % of the cooling gallery 22. Thus, during operation of the internal combustion engine, the metal-containing composition 24 flows throughout the cooling gallery 22 and dissipates heat away from the upper and lower crowns 32, 34 as the piston 20 reciprocates in the cylinder bore.

The metal-containing composition 24 includes a plurality of metal particles 66 dispersed throughout a base material 68. The base material 68 is typically present in an amount of 50 vol. % to 99 vol. %, based on the total volume of the metal-containing composition 24. In one embodiment, the base material 68 is present in an amount of 70 vol. % to 90 vol. %, based on the total volume of the metal-containing composition 24. In another embodiment, the base material 68 is present in an amount of 75 vol. %, based on the total volume of the metal-containing composition 24. The base material 68 typically has a thermal conductivity of 85 to 141 W/(m·K) and a melting temperature less than 181° C., and thus is liquid at temperatures of 181° C. and above.

As alluded to above, the base material 68 typically consists of oil, such as silicone oil. The base material 68 could alternatively comprise another liquid phase that is equally stable at high temperatures. In another embodiment, the base material 68 comprises one or more alkali metals. Alkali metals are elements found in Group 1 of the Periodic Table and include lithium (Li), sodium (Na), potassium (K), rubidium (Rb), caesium (Cs), francium (Fr), and ununennium (Uue). The alkali metals can be provided as individual elements or alloys, such as NaK. The alkali metals typically have a thermal conductivity of about 85 to 141 W/(m·K), which is much higher than the thermal conductivity of lubricant oils. For comparison purposes, lubricant oils have a thermal conductivity around 0.15 to 0.20 W/(m·K). The high thermal conductivity of alkali metals allows them to effectively transfer heat away from the upper and lower crowns 32, 34. The alkali metals also typically have a melting temperature of about 63 to 181° C. Thus, the alkali metals are provided as a solid at room temperature and transform to a liquid when exposed to temperatures higher than their melting temperature during operation of the internal combustion engine. For example, sodium has a thermal conductivity of about 141 W/(m·K) and a melting temperature of about 98° C.; potassium has a thermal conductivity of about 102 W/(m·K) and a melting temperature of about 63° C.; and lithium has a thermal conductivity of about 85 W/(m·K) and a melting temperature of about 181° C. The alkali metals may be highly reactive and thus the outer cooling gallery 22 should be securely sealed.

The metal particles 66 of the metal-containing composition 24 are dispersed throughout the base material 68. The metal particles 66 have a thermal conductivity and a melting temperature greater than the thermal conductivity and the melting temperature of the base material 68. Typically, the metal particles 66 have a melting temperature greater than 181° C. and a thermal conductivity greater than 200 W/(m·K). Thus, the metal particles 66 remain solid and suspended throughout the liquid base material 68 when exposed to high temperatures during operation of the internal combustion engine. Thus, the solid metal particles 66 can provide exceptional heat absorption and dissipation while the liquid base material 68 provides excellent thermal contact. The metal particles 66 typically consist of one or more elements selected from the group consisting of copper (Cu), aluminum (Al), beryllium (Be), tungsten (W), gold (Au), silver (Ag), and magnesium (Mg). As alluded to above, in one exemplary embodiment, the metal-containing composition 24 includes the copper particles suspended in the silicone oil. Alternatively, the metal-containing composition 24 includes the copper particles suspended in the blend of alkali metals.

The metal-containing composition 24 includes the metal particles 66 in an amount of 1 vol. % to 50 vol. %, based on the total volume of the metal-containing composition 24. In one embodiment, the metal particles 66 are present in an amount of 10 vol. % to 30 vol. %, based on the total volume of the metal-containing composition 24. In yet another embodiment, the metal particles 66 are present in an amount of 25 vol. %, based on the total volume of the metal-containing composition 24.

The metal particles 66 typically have a particle size less than 149 microns to less than 25 microns (−100 to −550 mesh), or less than 44 microns (−325 mesh). All of the metal particles can have the same size particle, but typically the metal particles have a distribution of particle sizes. For example, 50% by volume of the metal particles can have a particle size of −100 mesh to +400 mesh and 50% by volume of the metal particles can have a particle size of −400 mesh. The metal particles 66 can also have various different structures. For example, the metal particles 66 could be atomized particles, such as those formed by water atomization or gas atomization. Alternatively, the metal particles 66 could be in the form of a strand, sponge, or foam. The metal particles 66 may also be recovered from a waste stream during the production process of other objects, such as brake parts.

The piston 20 including the high thermal conductivity metal-containing composition 24 in the outer cooling gallery 22 can provide numerous advantages. During operation of the internal combustion engine, the base material 68, such as the oil or the alkali metal, is in a liquid form, while the metal particles 66 remain solid and are suspended in the liquid base material 68. The liquid base material 68 carries the solid metal particles 66 along the inner surfaces 42 of upper and lower crowns 32, 34, throughout the cooling gallery 22, and thus removes heat from the upper crown 32 and lower crown 34. Furthermore, the metal-containing composition 24 does not degrade due to high temperatures during the lifetime of the engine, and no coking of the cooling gallery 22 occurs. The re-distribution of heat flow towards the ring grooves 52 also reduces carbon deposits along the outer surface 40, such as on the piston lands, and reduces degradation of any lubricant oil used along the outer surface 40. These advantages can extend the time between service intervals of the engine. In addition, the absence of carbon build up on the outer surface 40 of the piston 20 impedes cylinder liner bore polishing and consequently maintains oil consumption under control. Another beneficial characteristic that results from cooling the piston 20 with the metal-containing composition 24 in the cooling gallery 22 is the absence of carbon build up in the first (uppermost) ring groove 52. This obviates the possibility of carbon jacking of the compression ring and consequent ring seizure and/or ring sticking, which are both deleterious to the performance of the piston 20.

Another aspect of the invention provides a method of manufacturing a piston 20 for an internal combustion engine, comprising the steps of feeding the metal-containing composition 24 into the cooling gallery 22, and sealing the cooling gallery 22. Various different methods can be used to form the piston 20 with the cooling gallery 22. However, according to one exemplary embodiment, the method includes forming the upper crown 32 and the lower crown 34, aligning the inner ribs 46, 50 and outer ribs 44, 48 of the upper and lower crowns 32, 34 longitudinally, and welding the ribs 44, 46, 48, 50 of the upper and lower crowns 32, 34 together to form the cooling chamber 62 and cooling gallery 22 therebetween, as shown in FIG. 1. The exemplary method next includes forming the opening 56 to the cooling gallery 22. This step may include drilling a hole in the upper crown 32. In another preferred embodiment, the method includes drilling the opening 56 in the lower crown 34, for example through the second inner rib 50 and along the non-thrust plane of the piston 20.

The method further includes feeding the metal-containing composition 24 through the opening 56 and into the cooling gallery 22 generally under an inert, dry atmosphere, typically nitrogen or argon. During the feeding step, the metal-containing composition 24 can be solid, liquid, or a mixture of solid particles and liquid. The metal particles 66 are typically solid during the feeding step, but the base material 68 can be solid or liquid. For example, when the metal-containing composition 24 comprises the colloid composition, the oil acts as a carrier for the solid metal particles 66, and the solid metal particles 66 are dispersed throughout the oil and poured into the opening 56 of the upper crown 32 or lower crown 34. However, when the base material 68 comprises the alkali metals, the method can include melting the alkali metals to provide a carrier, such that the metal particles 66 are dispersed throughout the melted alkali metals. Alternatively, the alkali metals can also be in the form of solid particles and blended with the solid metal particles 66. This mixture of solid particles can also be poured into the opening 56 of the upper crown 32 or lower crown 34. The solid alkali metal particles 66 transition to a liquid and provide a carrier for the solid metal particles 66 when exposed to the high temperatures during operation of the internal combustion engine.

After the metal-containing composition 24 is fed into the cooling gallery 22, the method includes sealing the opening 56 to the cooling gallery 22 while the piston 20 is still disposed in the inert atmosphere. The sealing step typically includes threading and tightening the plug 58 in the opening 56, and then applying the adhesive to the plug 58, such as a high temperature epoxy composition. In another embodiment, the opening 56 can be sealed by press fitting the plug 58 in the opening 56, which reduces production time. In yet another embodiment, the plug 58 can alternately be sealed by maintaining the piston 20 in the inert atmosphere, and then tungsten inert gas (TIG) welding or laser welding the plug 58 to the upper crown 32. Brazing and shrink-fit plugs are alternative ways also contemplated.

Obviously, many modifications and variations of the present invention are possible in light of the above teachings and may be practiced otherwise than as specifically described while within the scope of the appended claims.

What is claimed is:

1. A piston for an internal combustion engine, comprising:

a body portion including an upper crown and a cooling gallery extending along at least a portion of said upper crown, the cooling gallery being sealed;

a metal-containing composition disposed in said cooling gallery;

said metal-containing composition including a base material that is in liquid or solid form at operating temperatures below 180° C. and is liquid form at operating temperatures above 180° C. and a plurality of metal particles having a thermal conductivity greater than the thermal conductivity of said base material.

2. The piston of claim 1, wherein said metal particles consist of one or more elements selected from the group consisting of copper (Cu), aluminum (Al), beryllium (Be), tungsten (W), gold (Au), silver (Ag), and magnesium (Mg).

3. The piston of claim 1, wherein said metal particles are solid at a temperature of 181° C.

4. The piston of claim 1, wherein said base material of said metal-containing composition consists of oil.

5. The piston of claim 4, wherein said oil is silicone oil.

6. The piston of claim 5, wherein said metal particles consist of copper.

7. The piston of claim 1, wherein said base material of said metal-containing composition consists of one or more alkali metals.

8. The piston of claim 7, wherein said base material consists of a mixture of alkali metals.

9. The piston of claim 8, wherein said base material consists of a mixture of sodium and potassium and said metal particles consist of copper.

10. The piston of claim 1, wherein said metal-containing composition includes said base material in an amount of 50 vol. % to 99 vol. % and said metal particles in an amount of 1 vol. % to 50 vol. %, based on the total volume of said metal-containing composition.

11. The piston of claim 1, wherein said metal particles have a thermal conductivity of greater than 200 W/(m·K).

12. The piston of claim 1, wherein said metal particles include a mixture of different particle sizes each being less than 149 microns.

13. The piston of claim 1, wherein said metal-containing composition fills 20 vol. % to 50 vol. % of said cooling gallery, based on the total volume of said cooling gallery.

14. The piston of claim 1, wherein said body portion includes a lower crown, said upper crown includes a first outer rib and a first inner rib, said lower crown includes a second outer rib and a second inner rib; each of said ribs extending circumferentially around a center axis; said second inner rib is connected to said first inner rib and said second outer rib is connected to said first outer rib to present said cooling gallery extending circumferentially around said center axis between said inner ribs and said outer ribs.

15. The piston of claim 1, wherein the body portion is formed of a steel material;

said body portion extends circumferentially around a center axis and longitudinally along said center axis from an upper end to a lower end;

said upper crown presents an outer surface and an oppositely facing inner surface and said cooling gallery extends along at least a portion of said inner surface of said upper crown;

said outer surface of said upper crown presents a bowl-shaped configuration at said upper end;

said upper crown includes a first outer rib and a first inner rib each extending circumferentially around said center axis and longitudinally from said upper end toward said lower end, said first inner rib is disposed between said first outer rib and said center axis;

said outer surface of said first outer rib presents a plurality of ring grooves facing away from said center axis and extending circumferentially around said center axis for holding piston rings;

said body portion includes a lower crown extending from said upper crown to said lower end;

said lower crown presents an outer surface and an oppositely facing inner surface and said cooling gallery extends along least a portion of said inner surface of said lower crown;

said lower crown includes a second outer rib connected to said first outer rib and a second inner rib connected to said first inner rib, said second ribs extends circumferentially around said center axis between said upper end and said lower end to form said sealed cooling gallery between said inner ribs and said outer ribs along a portion of said inner surface of said upper crown opposite said bowl-shaped configuration;

said second ribs are connected to said first ribs by friction welds;

said outer surface of said lower crown presents at least one ring groove;

one of said upper crown and said lower crown includes an opening extending into said cooling gallery for allowing said metal-containing composition to be poured into said cooling gallery;

said inner surface of said upper crown and said inner ribs present a cooling chamber therebetween, said cooling chamber extends radially along a portion of said inner surface of said upper crown and longitudinally along said center axis and is open towards said lower end for being exposed to a cylinder bore;

said body portion includes a pair of pin bosses depending from said lower crown and including a pair of laterally spaced pin bores extending perpendicular to said center axis;

said body portion includes a skirt depending from said lower crown, said skirt being joined laterally to said pin bosses and spacing said pin bosses from one another;

said skirt includes an outer surface being convex for cooperation with said cylinder bore;

said metal-containing composition has a thermal conductivity measured in W/m·K ranging from 5 to 1000 times greater than cooling oil;

said metal particles of said metal-containing composition are in solid form at a temperature of 181° C.;

said metal-containing composition fills 20 vol. % to 50 vol. % of said cooling gallery, based on the total volume of said cooling gallery; and further comprising a plug threaded into said opening and sealing said cooling gallery.

16. The piston of claim 15, wherein said metal-containing composition is a colloid composition;

said metal-containing composition includes said base material in an amount of 50 vol. % to 99 vol. % and said metal particles in an amount of 1 vol. % to 50 vol. %, based on the total volume of said metal-containing composition;

said base material consists of oil;

said metal particles have a thermal conductivity of greater than 200 W/(m·K);

said metal particles have a particle size less than 149 microns;

said metal particles include at least two different particle sizes; and said metal particles consist of one or more elements selected from the group consisting of copper (Cu), aluminum (Al), beryllium (Be), tungsten (W), gold (Au), silver (Ag), and magnesium (Mg).

17. The piston of claim 15, wherein said metal-containing composition includes said base material in an amount of 50 vol. % to 99 vol. % and said metal particles in an amount of 1 vol. % to 50 vol. %, based on the total volume of said metal-containing composition;

said base material has a thermal conductivity of 85 to 141 W/(m·K) and a melting temperature of 63 to 181° C.;

said base material consists of one or more alkali metals, said one or more alkali metals including lithium (Li), sodium (Na), potassium (K), rubidium (Rb), caesium (Cs), francium (Fr), and ununennium (Uue);

said metal particles have a melting temperature greater than 181° C. and a thermal conductivity of greater than 200 W/(m·K);

said metal particles have a particle size less than 149 microns; and said metal particles consist of one or more elements selected from the group consisting of copper (Cu), aluminum (Al), beryllium (Be), tungsten (W), gold (Au), silver (Ag), and magnesium (Mg).

18. A method of manufacturing a piston for an internal combustion engine, comprising the steps of:

feeding a metal-containing composition into a cooling gallery extending along at least a portion of an upper crown of a piston, wherein the metal-containing composition includes a base material that is in liquid or solid form at operating temperatures below 180° C. and in liquid form at operating temperatures above 180° C. and a plurality of metal particles having a thermal conductivity greater than the thermal conductivity of the base material; and sealing the cooling gallery.

19. The method of claim 18, wherein the base material and the metal particles are solid during the feeding step.

20. The method of claim 18, wherein the base material is a liquid and the metal particles are solid during the feeding step.

* * * * *